United States Patent [19]

Shinohara et al.

[11] Patent Number: 4,486,472

[45] Date of Patent: Dec. 4, 1984

[54] METHOD OF PREVENTING A COMBUSTION FURNACE FROM CORROSION

[75] Inventors: Takanobu Shinohara, Chiba; Toshio Anzai; Tatsuji Shinogaya, both of Mobara, all of Japan

[73] Assignees: Toyo Engineering Corp.; Nippon Zeon Co., Ltd., both of Tokyo, Japan

[21] Appl. No.: 451,319

[22] Filed: Dec. 20, 1982

[30] Foreign Application Priority Data

Dec. 28, 1981 [JP] Japan ..... 56-214121

[51] Int. Cl.[3] ..... B05D 7/22

[52] U.S. Cl. ..... 427/239; 427/236; 427/343

[58] Field of Search ..... 427/230, 236, 239, 427, 427/343, 348; 428/469

[56] References Cited

U.S. PATENT DOCUMENTS

| | | | |
|---|---|---|---|
| 2,299,748 | 10/1942 | Hatch | 427/239 |
| 3,156,263 | 11/1964 | Adelman | 427/239 |
| 3,245,830 | 4/1966 | Flexon et al. | 427/376.1 |
| 4,264,651 | 4/1981 | Hasson et al. | 427/239 |

*Primary Examiner*—Sadie L. Childs

*Attorney, Agent, or Firm*—Flynn, Thiel, Boutell & Tanis

[57] ABSTRACT

Corrosion of a combustion furnace is prevented by a coating of an alkali metal carbonate or an alkaline earth metal carbonate formed on metal surfaces of the furnace before it has started operation.

10 Claims, 1 Drawing Figure

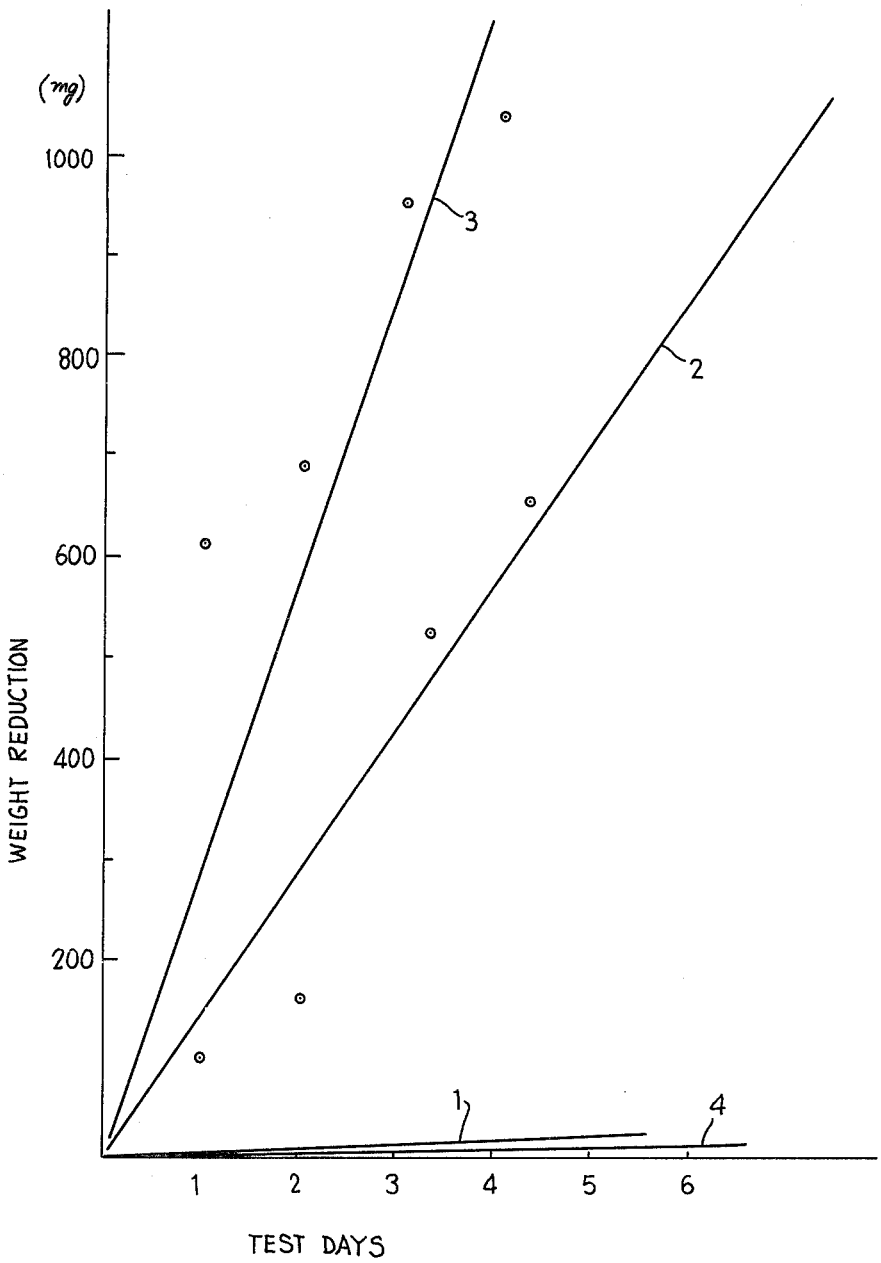
(mg)
1000
800
600
400
200
WEIGHT REDUCTION
3
2
1
4
1
2
3
4
5
6
TEST DAYS

METHOD OF PREVENTING A COMBUSTION FURNACE FROM CORROSION

This invention relates to a method of preventing corrosion of metal exposed to combustion gases containing HCl.

Extensive research and development has been carried out recently concerning various apparatuses which make effective use of the heat quantity of high temperature combustion gases generated by the combustion of materials containing chlorides such as wastes, and some of these apparatuses have already been commercialized. In the apparatuses of this kind, the high temperature combustion gases contain corrosive gases such as HCl, $Cl_2$, $SO_x$, etc., and are accompanied by ash consisting of unburnt materials, alkali metal salts, heavy metal salts and other solid materials generated by the combustion. The ash and HCl adhere to the surface of any metal exposed to the high temperature combustion gases and severely corrode the metal at high temperatures. The corrosion speed increases with temperature. In other words, high temperature corrosion occurs at surface temperatures of the metal of around 300° C. and proceeds violently, especially when the temperature is about 400° C. Of commercially available metals, none can withstand this high temperature corrosion with the exception of special high grade metallic materials.

To prevent this corrosion, various methods have been proposed in the past, such as a method in which the acidic corrosive gases generated during combustion are made to react with sodium carbonate to convert them into neutral salts, a method which feeds granular calcium carbonate into a furnace for incinerating polyvinyl chloride, a method which feeds an alkaline material together with the waste into a furnace in the fluidization-combustion of waste which generates HCl, and so on. Though these methods are certainly effective, mainly for treating the corrosive gases in the combustion gases, they are not yet sufficient as anticorrosive methods against the high temperature corrosion that occurs on metal surfaces to which ash and HCl adhere together. Due to various factors such as the geometrical relationship between the internal structure of the furnace and the metal surfaces on which the high temperature corrosion occurs, the fluidization state of the combustion gases, the degree to which corrosion gases mix and combine with the neutralization agent, etc., the carbonates cannot sufficiently reach some parts of the metal surfaces and adhere thereon.

When recovering the combustion heat of waste as steam in a boiler, or a waste heat boiler or the like, the following two methods have been used in practice as methods of avoiding high temperature corrosion. The first method keeps the temperature of the tube walls of the heat transfer tubes of the boiler below 400° C. Accordingly, the design values of the generated steam must be 20 kg/cm$^2$G and below 300° C., whereas they are between 16 and 20 kg/cm$^2$G, and approximately 200° C., respectively, in practical apparatuses. This kind of medium pressure steam has a low power generation efficiency and applications other than power generation are limited. The second method first generates medium pressure steam from combustion gases in a waste combustion chamber, and then introduces this medium pressure steam into a heater disposed inside a heavy oil combustion chamber to super-heat the steam. Although this method provides the advantage that high temperature, high pressure steam can be obtained, it involves the drawbacks that various equipment such as the heavy oil combustion chamber, the heater and other heat-exchangers and a separate fuel such as heavy oil are necessary.

The present invention provides a method of preventing high temperature corrosion and eventually, a method of obtaining high pressure steam economically.

The method of the present invention is characterized in that a sufficient quantity of an alkali metal carbonate or an alkaline earth metal carbonate is provided over the metal surfaces inside the combustion furnace before the furnace starts operating so that the ash generated during combustion is deposited on top of the carbonate layer.

In accordance with the method of the present invention, the carbonate of the alkali or alkaline earth metal carbonate layer, that is provided in advance in a sufficient quantity over a metal surface, reacts with HCl and converts it to neutral ash even if HCl and ash get close to the high temperature metal surface, thereby preventing the occurrence of high temperature corrosion on the metal surface. In other words, the carbonate firmly adhering to the metal surface reacts with the HCl to form a neutral salt ash, and is gradually consumed by the HCl in the combustion gases which comes into contact with the carbonate, as the operation of the furnace continues. In order to maintain the desired anticorrosive effects for a required period of time, it is therefore necessary to ensure that the amount of carbonate deposited, pointed or coated onto the metal surface is in excess of the stoichiometric quantity of HCl reaching the metal surface within that period. It is possible to reduce the quantity of HCl reaching the metal surface, or to supplement the quantity of the carbonate on the metal surface, by feeding carbonate either continuously or intermittently into the combustion zone, or into the flow path of the combustion gases after the furnace starts operating, once the method of the present invention is practised.

The carbonates of sodium, potassium, calcium or magnesium can be used as the alkali or alkaline earth metal salt but sodium carbonate is the most suitable of them from the point of view of the anticorrosive effect, and also economy. Though the carbonate layer can be formed over the metal surface by any usual method, granular or powdered carbonate can be mixed with a spreader and then pointed or coated onto the metal surface. For example, a carbonate powder is mixed and dispersed in an organic polymer compound which is liquid at normal temperatures and has a high viscosity, and it is then coated onto the metal surface. As the operation of the combustion furnace continues, the organic polymer compound is burnt or decomposed by the high temperature combustion gases but the carbonate remains on the metal surface, thereby accomplishing the intended object. Any spreader can be used so long as it enables the carbonate to adhere to the metal surface. In the high temperature combustion gases after the furnace starts operating, it can remain as it was when it was applied, or it can remain after incomplete combustion, or it can come off partially from the metal surface upon decomposition so long as the carbonate remains on the metal surface, reacts with HCl and prevents the permeation of the HCl to the metal surface. The particle size of the carbonate is selected as appropriate according to the kind of carbonate, the spreader, the HCl, the ash, the fluidization of the combustion gases, the condition of the metal surface, and other factors. Generally, however, the particle size is between ten microns and one thousand microns, preferably several hundreds microns, especially 800 microns.

BRIEF DESCRIPTION OF THE DRAWING

The drawing is a graph showing the weight reduction of testpieces under high temperature corrosion compared with the weight reduction when the method of the present invention is practised.

Next, the effects of the present invention will be described with reference to the drawing. The drawing illustrates the results obtained by experiments under the following conditions. The abscissa represents the time-scale of the experiment (in days), and the ordinate represents the reduction in weight of a metal testpiece (mg/surface area/5 $cm^2$). The lines 1 through 4 represent the data under the test conditions shown in Table 1.

TABLE 1

| | Coating Carbonate | Ash Adhesion | Presence of NaCl in ash | Corrosion Speed |
|---|---|---|---|---|
| Line 1 | None | None | None | Extremely low |
| Line 2 | None | Yes | None | About 4.5 mm/year |
| Line 3 | None | Yes | Yes | About 9.0 mm/year |
| Line 4 | Yes | Yes | Yes | Extremely low |

The metal testpiece was of SUS321 having a surface area of 15 $cm^2$. The temperature of the metal surface, which was exposed to a high temperature reducing gas consisting of 30% steam, 10% $CO_2$, 1,000 ppm HCl, 20 ppm $SO_2$ the balance being $N_2$ and $O_2$, was 600° C. The ash in the tests indicated by lines 2, 3 and 4 was collected from a refuse incineration furnace and had a composition of 7.1% aluminum, 3.8% sodium, 2.8% potassium, 14.5% calcium, 1.5% magnesium, 6.1% iron, 15.2% silicon, 2.1% chlorine, 1.1% total sulfur, with a 0.1% water content. The balance was primarily oxygen that combined with these elements. The line 4 represents data obtained by practising the method of the present invention. For the carbonate coating, 80% by weight $Na_2CO_3$ and 20% by weight of a silicone resin organic polymer compound were mixed and then coated over the surface of the testpiece to a thickness of 200 μm. In the test of line 3, a weight ratio of 82% ash and 18% NaCl were mixed and placed on the testpiece for the exposure to the high temperature atmospheric gas.

As shown by line 1 in the drawing, the weight reduction, that is, the quantity of corrosion, is extremely small unless ash adheres to the metal surface, even if there are considerable quantities of HCl in the atmospheric gas. However, when the high temperature gas contains HCl and the ash adheres directly to the metal surface, corrosion is extensive, as shown by lines 2 and 3 in the drawing. If there is NaCl in the ash, HCl is formed in accordance with the following reaction:

$$4NaCl+2SO_2+O_2+2H_2O \rightarrow 2Na_2SO_4+4HCl.$$

It has been assumed that the resulting HCl promotes corrosion. The test results of line 3 in the drawing gives clear proof of this assumption. For line 3 where NaCl was also present, the corrosion quantity is greater than that of line 2 in which there was only ash, and the corrosion speed is also higher.

After the furnace starts operating, the carbonate adhering to the metal surface exhibits its anticorrosive effect and is consumed at the same time. After the carbonate is completely consumed, the anticorrosive effect disappears and corrosion starts. Accordingly, the anticorrosive method of the present invention can be perfected by periodically spraying or injecting carbonate into the combustion gases after the passage of a predetermined period of time after the start of the furnace operation. To confirm this, the following test was conducted. Similar SUS321 testpieces to those used in the tests of FIG. 1 were coated with a 50:50 (by weight) mixture of $Na_2CO_3$ and a silicone resin organic polymer compound to a thickness of 50 μm. The ash used in the tests of the drawing was placed to a thickness of 3 mm on each of a group of the testpieces and the testpieces were exposed to a high temperature atmospheric gas for an extended period of time. After the passage of two months, the testpieces were locally corroded in pits, and some had deep corrosion holes.

In contrast, a mixture consisting of 70% by weight of the above ash, 15% by weight NaCl and 15% by weight $Na_2CO_3$ was placed to a thickness of 3 mm on each of another group of pre-coated testpieces. The testpieces were exposed to the high temperature atmospheric gas for an extended period of time. After a continuous test over three months, the group of testpieces did not exhibit any evidence of non-uniform corrosion on their surfaces, although there was foreign matter such as scale adhering to the testpieces which could be removed by a de-scaling treatment, thereby reducing the weight. However, the quantity was small, less than 0.1 mm in terms of corrosion in a year. In other words, the testpieces seemed to be completely anticorroded. This good result arose from the 15% by weight $Na_2CO_3$ that was previously mixed with the ash so as to represent a supplement of $Na_2CO_3$.

The embodiments of the invention in which an exclusive property or privilege is claimed are defined as follows:

1. A method of reducing corrosion of a furnace, which comprises the steps of:

prior to operating said furnace, forming a firmly adherent coating layer comprising a carbonate selected from the group consisting of alkali metal carbonates and alkaline earth metal carbonates, on the portion of the interior metal surface of said furnace that will be contacted by ash during operation of said furnace; and then operating said furnace by burning materials containing chlorides so as to generate a high temperature combustion gas containing ash suspended therein and containing gaseous hydrochloric acid, and contacting said coating with said ash and said gaseous hydrochloric acid during said burning so that said carbonate reacts with hydrochloric acid to form a neutral salt ash, thereby preventing corrosion of said portion of said interior metal surface during operation of the furnace.

2. A method as claimed in claim 1, in which said carbonate is selected from the group consisting of sodium carbonate, potassium carbonate, calcium carbonate and magnesium carbonate and has a particle size of from 10 to 1000 microns.

3. A method as claimed in claim 1, further comprising the step of injecting said carbonate into said furnace during operation of said furnace to supplement said coating layer.

4. A method as claimed in claim 3, wherein said carbonate is injected into the flow path of said high temperature combustion gas.

5. A method as claimed in claim 1, wherein said carbonate is sodium carbonate.

6. A method as claimed in claim 1, wherein said coating layer consists essentially of said carbonate and an organic polymer which is liquid at normal temperatures and has a high viscosity, which organic polymer is effective to form said coating layer, said carbonate being in the form of particles having particle sizes in the range of 10 to 1000 microns dispersed in said organic polymer.

7. A method as claimed in claim 1, wherein ash adheres to said coating during said combustion reaction.

8. A method of reducing corrosion of a furnace, comprising:

prior to operating the furnace, coating the portion of the interior metal surface of the combustion chamber of the furnace that is likely to be contacted with ash during operation of the furnace, with a coating composition which consists essentially of (1) particles of a carbonate selected from the group consisting of sodium carbonate, potassium carbonate, calcium carbonate and magnesium carbonate, and (2) an organic polymer which is liquid at normal temperatures and has a high viscosity, said particles having sizes in the range of 10 to 1000 microns and being dispersed in said organic polymer; and then conducting a combustion reaction within said combustion chamber of said furnace whereby ash adheres to said coating and said coating is exposed to gaseous hydrochloric acid within said combustion chamber during said combustion reaction, such that said carbonate reacts with said gaseous hydrochloric acid to form a neutral salt ash, thereby reducing corrosion of said interior metal surface.

9. A method as claimed in claim 8, further comprising the step of injecting said carbonate into said furnace during operation of said furnace to supplement said coating.

10. A method as claimed in claim 8, wherein said carbonate particles have sizes of about 800 microns.

* * * * *